United States Patent [19]

Hetzel et al.

[11] Patent Number: 4,872,297

[45] Date of Patent: Oct. 10, 1989

[54] HEADER ASSEMBLY

[75] Inventors: Joseph R. Hetzel, Macedonia; Kenneth L. Virgins, Hudson, both of Ohio

[73] Assignee: Patio Enclosures, Inc., Macedonia, Ohio

[21] Appl. No.: 251,515

[22] Filed: Sep. 30, 1988

[51] Int. Cl.[4] ..... E04B 7/06

[52] U.S. Cl. ..... 52/92; 52/640; 52/645

[58] Field of Search ..... 52/92, 640, 645, 646

[56] References Cited

U.S. PATENT DOCUMENTS

| | | | |
|---|---|---|---|
| 3,798,853 | 3/1974 | Castle | 52/92 |
| 3,928,951 | 12/1975 | Murphy | 52/92 |
| 3,932,968 | 1/1976 | Heirich | 52/90 X |
| 4,261,143 | 4/1981 | Rizzo | 52/92 X |
| 4,327,532 | 5/1982 | Matthews | 52/92 |

*Primary Examiner*—Carl D. Friedman
*Assistant Examiner*—Anthony Williams
*Attorney, Agent, or Firm*—James A. Hudak

[57] ABSTRACT

Apparatus for adjustably attaching roof panels to the side walls of an enclosure and for securing the pitch of the roof panel with respect to the side walls after it has been established is disclosed. The apparatus includes a header support member which is placed on top of the side wall and has a longitudinally extending pocket therein. A header arm having a longitudinally extending yoke at one end thereof is received in the longitudinally extending pocket in the header support member. After the roof pitch has been established by rotating the yoke portion of the header arm within the pocket in the header support member, the header arm is fastened to the header support member to secure the roof pitch.

4 Claims, 2 Drawing Sheets

HEADER ASSEMBLY

TECHNICAL FIELD

The present invention relates, in general, to a header assembly for attaching roof panels to the side walls of an enclosure, such as a patio enclosure or the like, and, more particularly, to a header assembly which permits adjustment of the pitch of the roof panels with respect to the side walls and the securing of the pitch of the roof panels after it has been established.

BACKGROUND ART

Numerous apparatus are available for attaching roof panels to the side walls of an enclosure, such as a patio enclosure. Typically, such apparatus are relatively complex inasmuch as they include a number of cooperating components. Because of the number of components involved, such apparatus are relatively expensive to produce and time consuming to install on the side walls and the roof panels to be joined. In addition, these apparatus usually do not include means for securing the pitch of the roof after it has been established, i.e., the apparatus rely solely on the support member, such as a hanger bracket, on the opposite end of the roof panels to maintain the roof pitch. A more desirable approach is to secure the roof pitch by utilizing the header assembly on one end of the roof panels and the support member on the other end of the panels.

Because of the foregoing, it has become desirable to develop a header assembly which permits adjustment of the pitch of the roof with respect to the side walls of an enclosure and includes means for securing the roof pitch after it has been established.

SUMMARY OF THE INVENTION

The present invention solves the problems associated with the prior art and other problems by providing relatively simple apparatus for adjustably attaching roof panels to the side walls of an enclosure and for securing the pitch of the roof with respect to the side walls after it has been established. The apparatus includes a header support member which is placed on the top of the side wall and which includes a longitudinally extending pocket which is spaced apart from the top of the side wall. The header support member also includes a curved portion which is positioned so as to be oppositely disposed to the longitudinally extending pocket. A header arm is provided and has a longitudinally extending yoke at one end thereof and a curved portion adjacent the other end thereof. The longitudinally extending yoke in the header arm is slidably received within the longitudinally extending pocket in the header support member and is positioned therein so that the curved portion of the header arm is on the exterior of the curved portion of the header support member. The header arm is then attached to the underside of the roof panel to be supported. After attachment, the pitch of the roof panel can be adjusted by rotating the yoke on the header arm within the pocket in the header support member. After the roof pitch has been established, fasteners are placed in a spaced-apart relationship along the longitudinal axis of the header support member and the header arm and pass through their respective curved portions so as to secure the pitch of the roof.

DESCRIPTION OF THE PREFERRED EMBODIMENT

Figure 1:
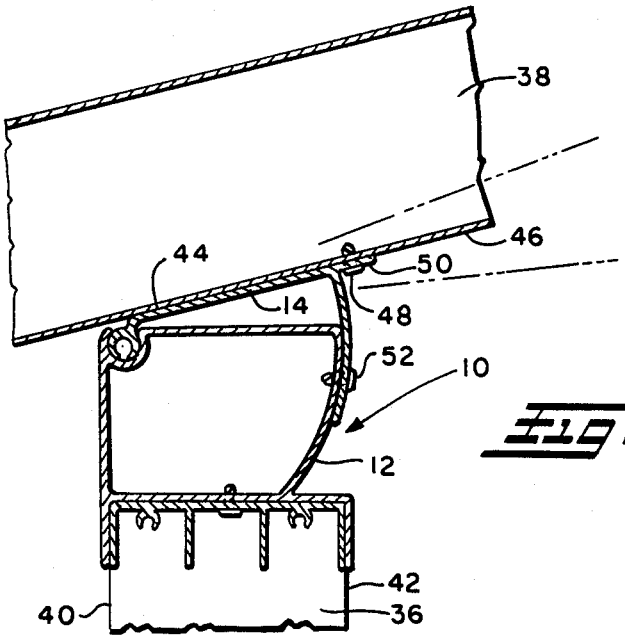
FIG. 1 is a front elevation view, in cross-section, of the present invention and illustrates the adjustability of the pitch of a roof panel with respect to a side wall of an enclosure.

Referring now to the drawings where the illustrations are for the purpose of describing the preferred embodiment of the present invention and are not intended to limit the invention hereto, FIG. 1 is a cross-sectional view of the header system 10 of the present invention. The header system 10 includes a header support member 12 and a header arm 14 which is pivotally attached thereto.

Figure 2:
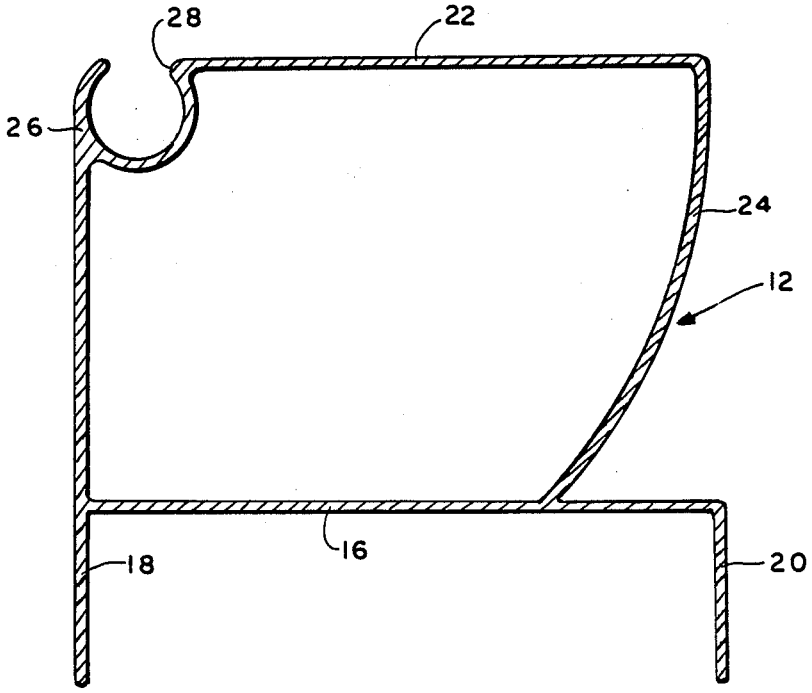
FIG. 2 is a front elevation view, in cross-section, of the header support member of the present invention.

Referring now to FIG. 2, a cross-sectional view of the header support member 12 is illustrated. The header support member 12 is typically formed as an extrusion, such as an aluminum extrusion formed from 6005-T5 aluminum, and includes a base portion 16, a first upright portion 18 which is connected to one end of the base portion 16, a second upright portion 20 which is connected to the other end of the base portion 16, a top portion 22, and a curved portion 24 which interconnects the top portion 22 with the base portion 16. The second upright portion 20 terminates at the base portion 16 and is substantially parallel to the first upright portion 18. The top portion 22 is substantially parallel to the base portion 16. A longitudinally extending pocket 26 is positioned adjacent the junction of the first upright portion 18 and the top portion 22. The longitudinally extending pocket 26 has a substantially circular cross-section and a longitudinally extending opening 28 along its top surface. The transverse width of opening 28 is greater than the radius of the surface forming the pocket 26. The thickness of the webs forming the base portion 16, the first upright portion 18, the second upright portion 20, the top portion 22, the curved portion 24, and the pocket 26 are substantially the same and typically are approximately 0.065 inches. It should be noted that the transverse distance between the first upright portion 18 and the second upright portion 20 is approximately the same as the thickness of the structure on which the header support member 12 will be placed.

Figure 3:
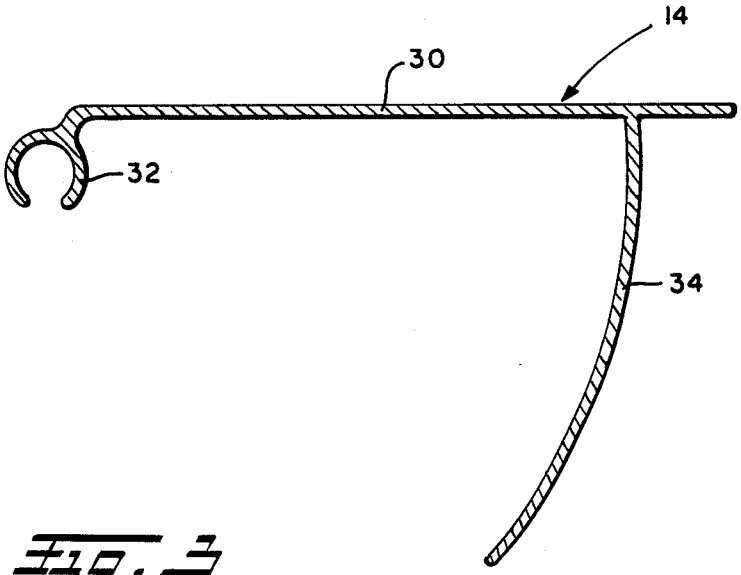
FIG. 3 is a front elevation view, in cross section, of the header arm of the present invention.

Referring now to FIG. 3, a cross-sectional view of the header arm 14 is illustrated. The header arm 14 is typically formed as an extrusion, such as an aluminum extrusion formed from 6005-T5 aluminum, and is comprised of a base portion 30 having a longitudinally extending yoke 32 attached to one end thereof and a curved portion 34 adjacent the opposite end thereof. The outer diameter of the yoke 32 is slightly smaller than the inner diameter of the pocket 26 in the header support member 12. The yoke 32 is offset from the base portion 30 by an obtuse angle formed therebetween. The radius of curvature of the curved portion 34 with respect to the center of the yoke 32 is approximately the same as the radius of curvature of curved portion 24 of the header support member 12 with respect to the center of the pocket 26 therein. The radial distance between the longitudinally extending yoke 32 and the curved portion 34 is such that the curved portion 34 is on the outside of curved portion 24 of the header support member 12 when the yoke 32 on the header arm 14 is received within the pocket 26 in the header support member 12. The thickness of the webs forming the base portion 30, the yoke 32 and the curved portion 34 are substantially the same, and approximate the thickness of the aforementioned portions comprising the header support member 12.

In order to assemble the header system 10, the longitudinally extending yoke 32 on the header arm 14 is slidingly received within the longitudinally extending pocket 26 in the header support member 12. The header support member 12 is then placed on the top surface of a structure 36, such as a side wall, which is to be attached to a roof panel 38. When the header support member 12 is so placed on the top surface of the structure 36, the first upright portion 18 and the second upright portion 20 of the header support member 12 grippingly engage the front surface 40 and the rear surface 42, respectively, of the structure 36. After placement of the header support member 12 on the top surface of the structure 36, the base portion 16 and/or the first and second upright portions 18 and 20 of the header support member 12 are attached to the top surface of the structure 36 by various fastening techniques. The top surface 44 of the header arm 14 is then attached to the bottom surface 46 of the roof panel 38 by means of fasteners 48, such as sheet metal screws, which are positioned in a spaced-apart relationship along the longitudinal axis of the bottom 50 of the header arm 14. After attachment, the pitch of the roof panel 38 can be adjusted by rotating the yoke 32 on the header arm 14 within the pocket 26 in the header support member 12 to establish the desired roof pitch. After the proper roof pitch has been established, fasteners 52, such as sheet metal screws, are placed in a spaced-apart relationship along the longitudinal axis of the header support member 12 and the header arm 14 so as to pass through their respective curved portions 24 and 34. In this manner, the pitch of the roof is secured after it has been established.

The opening 28 in the header support member 12 is of sufficient width to permit the yoke 32 on the header arm 14 to rotate within a wide arc with respect to the pocket 26 in the header support member 12, thus permitting substantial adjustment of the pitch of the roof panel 38 with respect to the side wall 36. In addition, the height of the first upright portion 18 and the curved portion 24 above the base portion 16 in the header support member 12 are sufficient to allow rotation of the header arm 14 through a wide arc with respect to the header support member 12 and the securing of the curved portions 24 and 34 after the roof pitch has been established. Furthermore, the height of the first upright portion 18 is such so as to provide substantial strength to the header support member 12 with respect to loads which are applied perpendicularly to the longitudinal axis of the support member 12.

Certain modifications and improvements will occur to those skilled in the art upon reading the foregoing. It should be noted that all such modifications and improvements have been deleted herein for the sake of conciseness and readability, but are properly within the scope of the following claims.

We claim:

1. Apparatus for attaching a roof panel to a side wall of an enclosure comprising a first elongated member having a base portion and a longitudinally extending portion having a longitudinally extending pocket formed therein, said base portion of said first elongated member having a configuration that conforms to the top of the side wall permitting the top of the side wall to be received therein for attachment thereto, said longitudinally extending portion of said first elongated member having a first portion substantially parallel to said base portion, a second portion substantially perpendicular to said first portion and joining one end of said first portion to one end of said base portion, and an arcuate portion oppositely disposed from said second portion and joining the other end of said first portion to said base member, said longitudinally extending pocket being positioned at the junction of said second portion with said one end of said first portion of said first elongated member, and a second elongated member for attachment to the roof panel, said second elongated member having a longitudinally extending yoke portion formed therein, said longitudinally extending yoke portion of said second elongated member being slidably receivable and rotatable within said longitudinally extending pocket within said first elongated member.

2. The apparatus as defined in claim 1 wherein said longitudinally extending pocket in said longitudinally extending portion of said first elongated member is positioned within said first portion of said first elongated member and is formed by a longitudinally extending slit, said slit being of sufficient transverse width to permit said second elongated member to rotate through a substantial arc with respect to said first elongated member.

3. The apparatus as defined in claim 1 wherein said second elongated member includes an arm portion having an axis which is angularly offset from the axis of said longitudinally extending yoke portion.

4. The apparatus as defined in claim 1 wherein said second elongated member includes an arcuate portion oppositely disposed to said yoke portion and having a configuration which conforms to said arcuate portion of said first elongated member permitting the receipt of fastening means through said arcuate portions securing the pitch of the roof after it has been established.

* * * * *